US007143553B2

(12) United States Patent
Fritsche et al.

(10) Patent No.: US 7,143,553 B2
(45) **Date of Patent: *Dec. 5, 2006**

(54) MODULAR MULTI-CONFIGURABLE DISPLAY

(75) Inventors: Mark Fritsche, Eagan, MN (US); Dan Berg, Minneapolis, MN (US); Jason Johnson, Minneapolis, MN (US)

(73) Assignee: Skyline Displays, Inc., Eagan, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/114,562

(22) Filed: Apr. 25, 2005

(65) Prior Publication Data

US 2005/0252054 A1 Nov. 17, 2005

Related U.S. Application Data

(63) Continuation of application No. 10/939,532, filed on Sep. 13, 2004, now Pat. No. 7,040,064, which is a continuation of application No. 10/662,132, filed on Sep. 12, 2003, now abandoned, which is a continuation-in-part of application No. 09/953,113, filed on Sep. 13, 2001, now abandoned.

(51) Int. Cl.
*E04H 1/00* (2006.01)

(52) U.S. Cl. ..... 52/239; 160/135

(58) Field of Classification Search ..... 52/239, 52/730.1, 731.1, 696, 690; 160/135, 352, 160/351, 328, 329, 405; 40/605, 610; 211/189, 211/192, 103, 207

See application file for complete search history.

(56) References Cited

U.S. PATENT DOCUMENTS

| | | | | |
|---|---|---|---|---|
| 767,533 | A | 8/1904 | Warner | |
| 1,939,598 | A | 12/1933 | Ragsdale | |
| 2,900,870 | A * | 8/1959 | Jackson | 359/451 |
| 3,734,033 | A | 5/1973 | Downing | |
| 3,975,850 | A | 8/1976 | Giaume | |
| D242,099 | S | 11/1976 | Casey | |
| D242,100 | S | 11/1976 | Casey | |
| 4,064,995 | A | 12/1977 | Bustos | |
| 4,194,313 | A | 3/1980 | Downing | |
| 4,263,738 | A | 4/1981 | Donatelle | |
| D259,443 | S | 6/1981 | James | |
| 4,288,937 | A | 9/1981 | Virsen | |
| 4,471,548 | A | 9/1984 | Goudie | |
| 4,566,211 | A | 1/1986 | Gustafson et al. | |
| 4,593,826 | A | 6/1986 | Bustos | |
| 4,658,560 | A * | 4/1987 | Beaulieu | 52/646 |

(Continued)

FOREIGN PATENT DOCUMENTS

| | | |
|---|---|---|
| CN | 3247677D | 7/2002 |

(Continued)

OTHER PUBLICATIONS

Skyline Displays, Inc., *ps2000 brochure*, 2001.

(Continued)

*Primary Examiner*—David Purol
(74) *Attorney, Agent, or Firm*—Patterson, Thuente, Skaar & Christensen, P.A.

(57) ABSTRACT

The modular multi-configurable display has a series of box frames and provides variable positioning for appurtenances. The display can include a plurality of vertical columns, and generally horizontal trusses. The columns are capable of receiving the trusses at each end of the columns. Each box frame can be stackable with another box frame such that the vertical span of the display is adjustable. Appurtenance can be attached at various positioning locations to the display such that a myriad of modular configuration combinations are available to an exhibitor.

19 Claims, 4 Drawing Sheets

U.S. PATENT DOCUMENTS

| | | | | |
|---|---|---|---|---|
| 4,759,159 | A | 7/1988 | Blazley | |
| 4,784,205 | A | 11/1988 | Johnson et al. | |
| 4,800,663 | A | 1/1989 | Zeigler | |
| 4,860,812 | A | 8/1989 | DePietro et al. | |
| 4,862,615 | A | 9/1989 | Hillstrom | |
| 4,901,499 | A | 2/1990 | Mairlot | |
| 4,934,858 | A * | 6/1990 | Beaulieu | 403/174 |
| D308,923 | S | 7/1990 | Ewenson | |
| 4,941,717 | A | 7/1990 | Beaulieu | |
| 4,986,038 | A | 1/1991 | Backer | |
| 5,038,529 | A | 8/1991 | Conley et al. | |
| 5,056,577 | A | 10/1991 | DeLong et al. | |
| 5,092,385 | A | 3/1992 | Beaulieu | |
| 5,111,631 | A | 5/1992 | Flood et al. | |
| 5,115,623 | A | 5/1992 | Ahlberg | |
| 5,119,613 | A | 6/1992 | Atkinson et al. | |
| 5,123,550 | A | 6/1992 | Nodskov et al. | |
| 5,193,603 | A | 3/1993 | Whisnant | |
| 5,277,512 | A | 1/1994 | Dwillies | |
| 5,323,836 | A | 6/1994 | Tuttle et al. | |
| 5,351,843 | A | 10/1994 | Wichman et al. | |
| 5,423,151 | A | 6/1995 | Caro et al. | |
| 5,439,043 | A | 8/1995 | Carter | |
| 5,486,391 | A | 1/1996 | Tyner | |
| 5,495,952 | A | 3/1996 | Kainz | |
| 5,501,051 | A | 3/1996 | Harlan | |
| 5,537,766 | A | 7/1996 | Nickens et al. | |
| 5,561,960 | A | 10/1996 | Minnick et al. | |
| 5,584,156 | A | 12/1996 | Lange | |
| 5,588,274 | A | 12/1996 | Lange | |
| 5,611,384 | A | 3/1997 | Carter | |
| D386,330 | S | 11/1997 | Russell | |
| 5,706,622 | A | 1/1998 | Lange | |
| 5,711,131 | A | 1/1998 | Thomas | |
| D392,753 | S | 3/1998 | Kohlberger et al. | |
| 5,822,945 | A | 10/1998 | Muller | |
| 5,875,596 | A | 3/1999 | Muller | |
| 6,079,178 | A * | 6/2000 | Fisher | 52/690 |
| 6,149,021 | A | 11/2000 | Beaulieu | |
| 6,158,187 | A | 12/2000 | Nakajima | |
| 6,419,331 | B1 | 7/2002 | Wei | |
| D471,726 | S | 3/2003 | Berg et al. | |
| D472,719 | S | 4/2003 | Berg et al. | |
| D473,385 | S | 4/2003 | Joergensen | |
| 6,571,519 | B1 * | 6/2003 | Diffrient et al. | 52/239 |
| 6,615,562 | B1 | 9/2003 | Fritsche et al. | |
| D482,204 | S | 11/2003 | Berg et al. | |
| D482,877 | S | 12/2003 | Berg et al. | |
| 6,659,159 | B1 | 12/2003 | Fritsche et al. | |
| D485,995 | S | 2/2004 | Berg et al. | |
| 6,712,229 | B1 | 3/2004 | Fritsche et al. | |
| 6,715,255 | B1 | 4/2004 | Schipani et al. | |
| D497,498 | S | 10/2004 | Berg et al. | |

FOREIGN PATENT DOCUMENTS

| | | |
|---|---|---|
| KR | 20-0234930 | 10/2001 |
| KR | 20-0234977 | 10/2001 |
| KR | 30-0298304-0000 | 5/2002 |
| KR | 30-0298305-0000 | 5/2002 |
| KR | 30-0298306-0000 | 5/2002 |
| KR | 10-0376542 | 10/2002 |
| KR | 10-0428425 | 10/2002 |
| KR | 20-0313104 | 5/2003 |
| KR | 30-0338741-0000 | 11/2003 |
| KR | 20-0353133 | 6/2004 |
| KR | 20-0353490 | 6/2004 |

WO WO 02/081837 10/2002

OTHER PUBLICATIONS

Skyline Displays, Inc., *image that, brochure*, 2000.
Skyline Displays, Inc., *design ideas brochure*, 2000.
Skyline Displays, Inc., *How Do You Market Your e-Business Offline? brochure*, 2001.
Skyline Displays, Inc., *mirage plus brochure*, 2001.
Skyline Displays, Inc., *skytruss brochure*, 2001.
Trussworks, Truss Catalog web page printout, *Truss Parts*, Aug. 17, 2001.
Trussworks, Truss Catalog web page printout, *Trussworks Photos, Graphics Frame*, pp. 1-2, Aug. 17, 2001.
Trussworks, Truss Catalog web page printout, *Trussworks Photos, Exhibit Photos*, pp. 1-2, Aug. 17, 2001.

* cited by examiner

MODULAR MULTI-CONFIGURABLE DISPLAY

RELATED APPLICATIONS

The present application is a continuation of U.S. patent application Ser. No. 10/939,532, filed Sep. 13, 2004 now U.S. Pat. No. 7,040,064, entitled, "MODULAR MULTI-CONFIGURABLE DISPLAY SYSTEM" by Mark Fritsche, Dan Berg, and Jason Johnson, which in turn is a continuation of U.S. patent application Ser. No. 10/662,132, filed Sep. 12, 2003, now abandoned, entitled, "MODULAR MULTI-CONFIGURABLE DISPLAY SYSTEM", by Mark Fritsche, Dan Berg, Jason Johnson, and Gordon Savoie, which in turn is a continuation-in-part application of U.S. patent application Ser. No. 09/953,113, filed Sep. 13, 2001, now abandoned, entitled, "MODULAR MULTI-CONFIGURABLE DISPLAY SYSTEM", by Mark Fritsche, Dan Berg, Jason Johnson and Gordon Savoie; each application hereby fully incorporated by reference in their entirety.

FIELD OF THE INVENTION

The present invention relates to displays, and in particular, to a modular display system for the multi-configurable assembly of a display stand at a trade show or other exhibition.

BACKGROUND OF THE INVENTION

Trade shows have been common for some time as a means for companies to significantly expand their client base. Generally, a trade show exhibitor is allocated a specific limited space within a large hall in which to set up a booth or display. It has been common practice for these exhibitors to purchase specially designed displays to showcase their products or services.

These conventional displays usually include a "back wall." This back wall is set as the focal point for the exhibition. However, while these back walls have generally been readily available and portable, they are often very limited in their use and can be quite expensive. For the most part, the currently available back walls come in limited configurations, with the display manufacturer designing a back wall specifically for the exhibitor. Consequently, conventional back walls are truly customized and are only capable of a limited number of configurations. Rectangular paneled back walls are often the only real configuration option and the exhibitor is only able to modify the look of the wall through the addition of furniture and shelves at predetermined locations.

The lack of configuration flexibility is problematic. First, trade show facilities can vary greatly. The overall size and shape of the exhibit space is an important consideration. A small space may require a reduction in the size of the back wall, while a larger space may present opportunities for the exhibitor to expand the wall and the draw or appeal of the exhibited products or services. In addition, a uniquely shaped booth space may present a problem for those exhibitors utilizing conventional back wall displays since the wall cannot be configured to conform with the space.

Second, exhibitors may wish to periodically change the configuration of the back wall for non-functional reasons. An exhibitor may simply wish to have options available to vary the look of the back wall in order to highlight specific products, influence a particular trade show audience, or for many other creative and aesthetic reasons. However, conventional back wall display systems are generally limited in this respect.

Limited component shapes, such as those used in rectangular panel systems, restrict the ability of an exhibitor to creatively configure the wall. Consequently, there is a need for a display booth back wall system that includes various components of convenient interchangeable shapes and sizes that permit an exhibitor to assemble the wall in a myriad of modular configurations. In addition, the back wall system must be designed for ease of disassembly and portability to accommodate the demands of trade show exhibitors.

SUMMARY OF THE INVENTION

The modular multi-configurable display system of the present invention includes multiple interchangeable components. Namely, the system includes a plurality of vertical columns, a plurality of horizontal truss members, including arcuate members, and a plurality of linear member. The columns are capable of fixedly removably receiving the horizontal arcuate and linear members at each end of the columns. Each column may be formed of one or typically two elongated box frames that are removably stackable and connectable with respect to each other. Each box frame has elongate frame members secured and braced with webbing only at the ends. Whereby appurtenant components can be attached at various positioning locations to a columns. Similarly, in a preferred embodiment, the trusses have only end webbing, no intermediate webbing, thereby providing substantially the entire length of the truss for attachment positions for appurtenances. A myriad of modular configuration combinations are available to an exhibitor.

A significant advantage and feature of the modular multi-configurable display system of the present invention is that configuration options are increased to accommodate an exhibitor's specific needs or creative desires.

Another significant advantage and feature of the present invention is its modular interchangeability and connectability. Each modular component (i.e., the arcuate and linear members) is in connectable communication with other components of identical or different design through an intermediary connection with a frame assembly. Common connectability with a frame assembly permits flexibility in defining the overall shape and size of the display wall. In addition, a specific component is not directed or limited to a particular connection position, or to an individually designated frame assembly. This significantly increases the ease of assembly and decreases the time associated with assembly and disassembly.

DETAILED DESCRIPTION OF THE PREFERRED EMBODIMENTS

Figure 1:
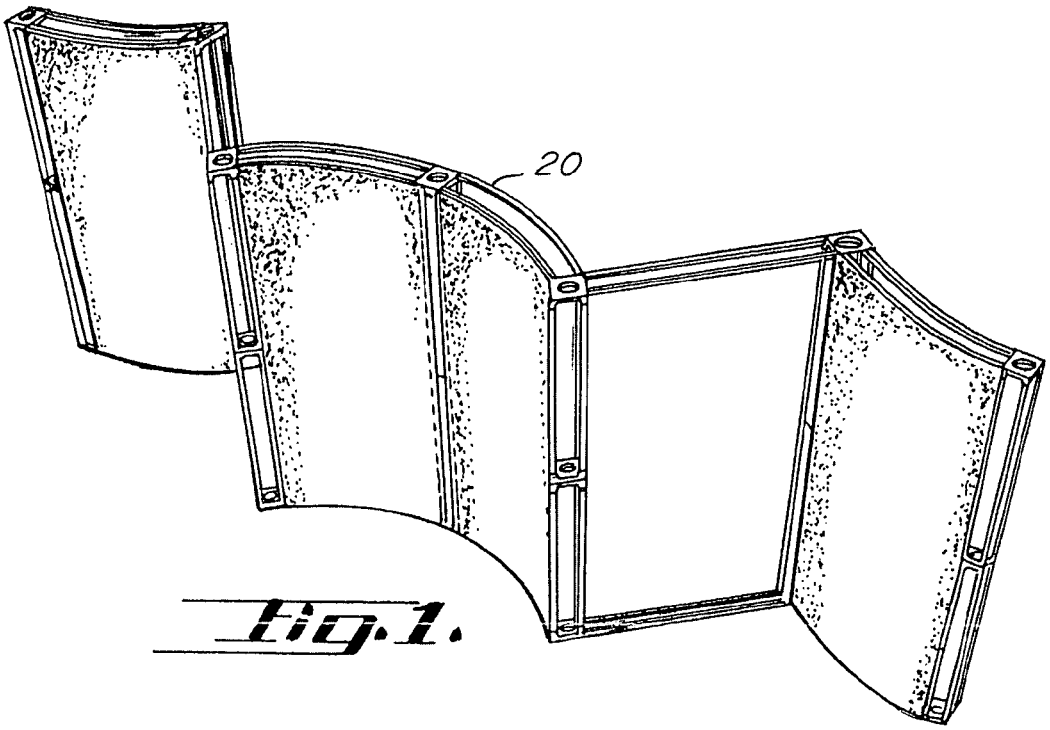
FIG. 1 is a perspective view of a display in accordance with the invention herein.
Figure 2:
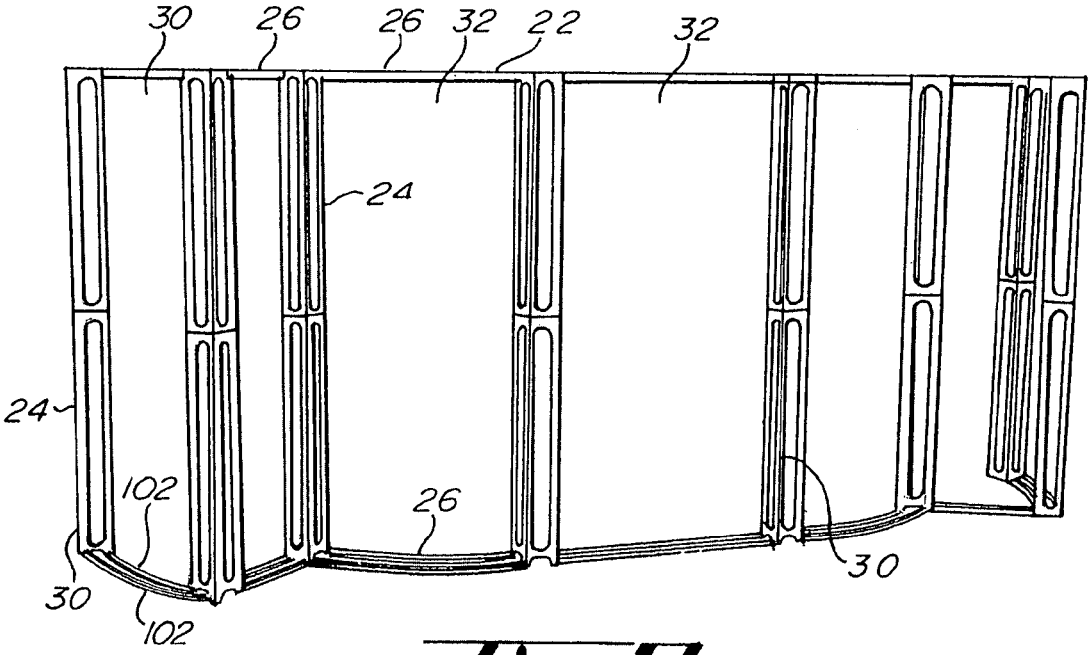
FIG. 2 is a front perspective view of a framework for a display.
Figure 9A:
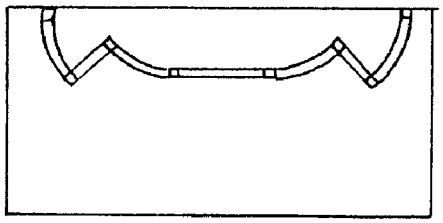
FIG. 9*a* is a plan view of one configuration of the modular multi-configurable display wall system of the present invention.
Figure 9B:
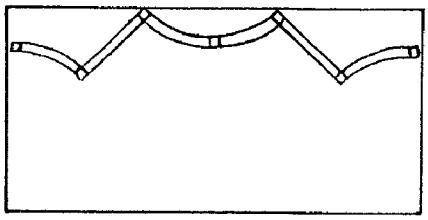
FIG. 9*b* is a plan view of another configuration of the modular multi-configurable display wall system of the present invention.
Figure 9C:
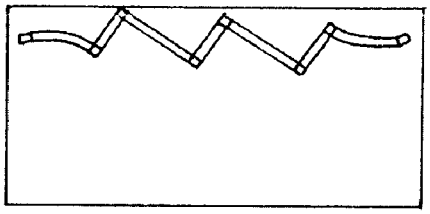
FIG. 9*c* is a plan view of yet another configuration of the modular multi-configurable display wall system of the present invention.

Referring to FIGS. 1 and 2, a display 20 suitable back wall of trade show exhibits is illustrated. FIG. 2 illustrates the framework 22 for the display and is generally comprised of a plurality of vertical columns 24 and a plurality of trusses 26 that are combined to form a series of graphical screen window frames 30 defining a plurality of graphical screen windows or openings 32. The window frames are generally laid out in a sequential manner to form a structurally stable display due to the serpentine shape.

Figure 3:
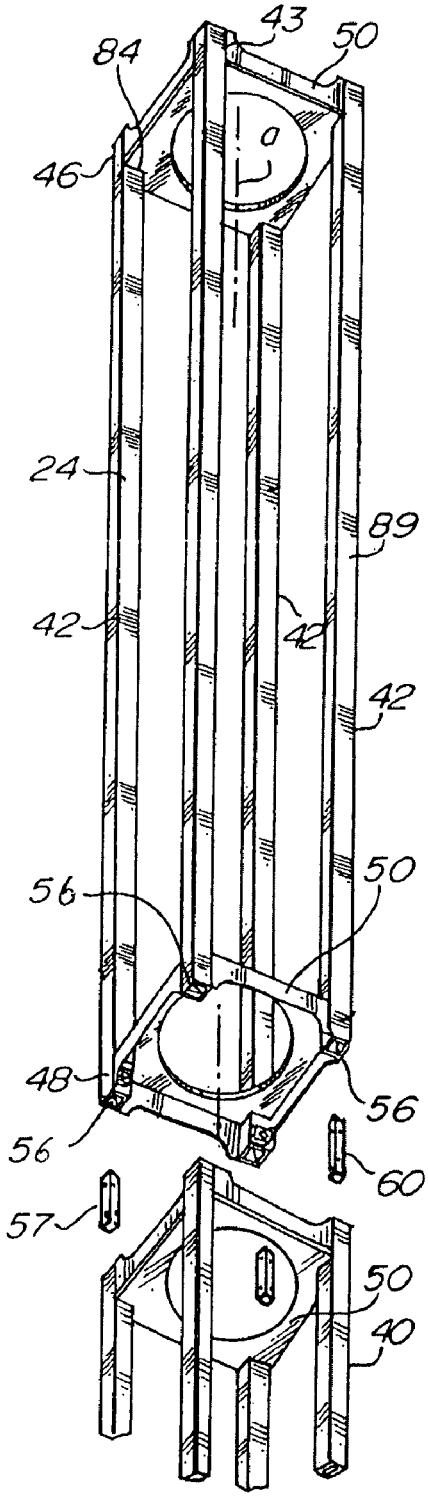
FIG. 3 is an exploded view of a column in accordance with the invention herein.
Figure 4:
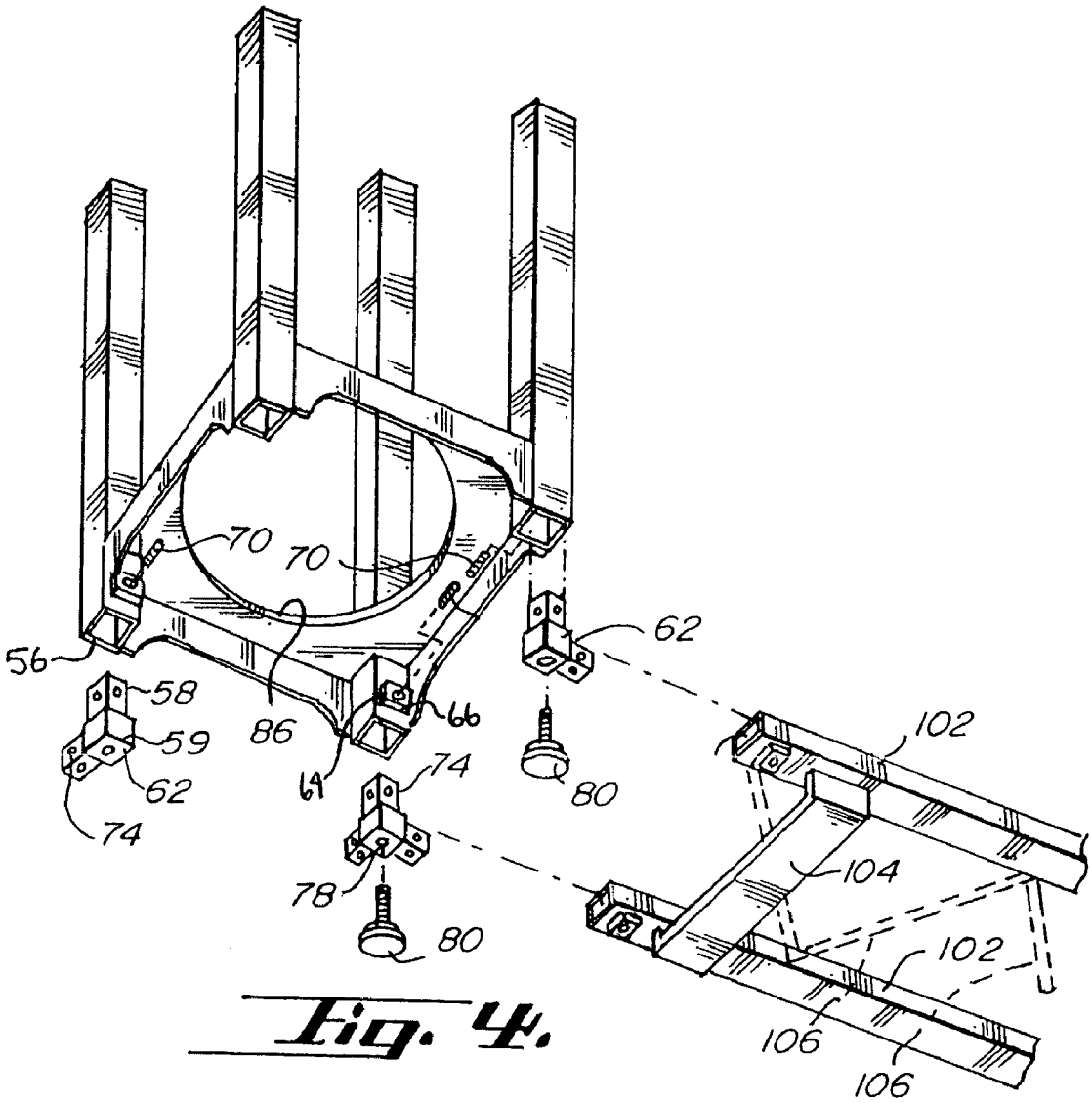
FIG. 4 is an exploded view of the connection between an elongate box frame and a truss.

Referring to FIG. 3, a portion of a vertical column 24 is illustrated. The column is composed of two elongated box frames 40, each presenting a longitudinal axis a. Each box frame in a preferred embodiment is comprised of four frame tubing segments 42 formed from square steel tubing. Each framed segment 42 has a first end 46 and a second end 48. Each of the respective first ends 46 of the four framed segments 42 is joined together by an end webbing 50 as well as are the second ends 48. The ends 46, 48 of the frame tubing segments 42 are opened defining a socket 56, which facilitates connection to another elongated box frame 40 or to a truss 26. Said connections are facilitated by in line connectors 60 as illustrated in FIG. 3, or right angle connectors 62 as illustrated in FIG. 4. In line connectors 60 have a portion 57, which is sized so as to be received in socket 56 of the frame tubing segments 42. The ends of the elongate box frames 46, 48 also have threaded portions 64 configured as nuts 66 welded onto the ends 48 of the steel tubing frame segments 42. Set screws 70 are threaded through threaded portions 64 to frictionally contact and thereby attach the connectors 60, 62. The connectors will preferably have indentations 74 at the set screw location points. Similarly, the right angle connectors 62 have a portion 58 sized so as to be received in socket 56. Right angle connectors 62 may also have body portion 59, which is sized slightly larger than socket 56 as depicted in FIG. 4. The right angle connectors may also have threaded bores 78 for attachment of feet 80 or other appurtenances.

Figure 5:
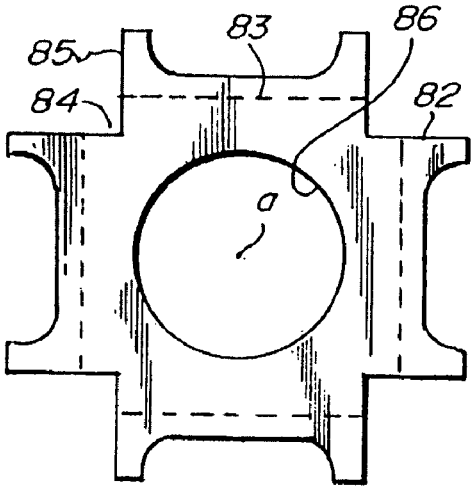
FIG. 5 is a plan view of a stamping for forming an end webbing.
Figure 5B:
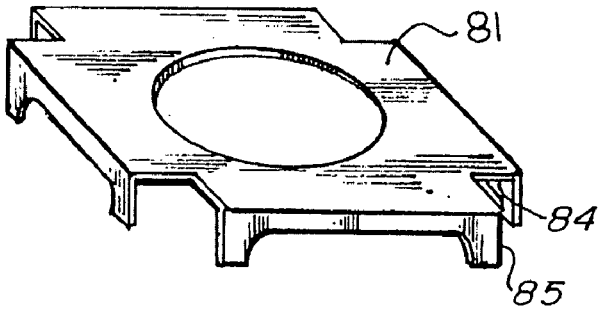
FIG. 5*b* is a perspective view of a formed webbing.

A piece of sheet steel 81 is illustrated in FIGS. 5 and 5*b*, which is suitable for forming the end webbing 50. Sheet steel piece 81 has notches 84 which conform in shape and dimension to the exterior of tubular frame segments 42. Perpendicular portions 85 as depicted in FIG. 5*b* are formed by bending sheet steel piece 81 along folding lined 83. To lighten the assembly, end webbing 50 may have one or more apertures 86 formed therein. The end webbing 50 is welded onto each of the four tubular frame segments 42 at welds 43 to form an optimally strong and light structure. Although the end webbing as illustrated is formed of a single unitary piece, it is also contemplated that the webbing could be formed of individual strips bridging individual frame segments. Thus webbing is defined as the structure securing segments together, whether a single unitary piece or multiple pieces.

Figure 8:
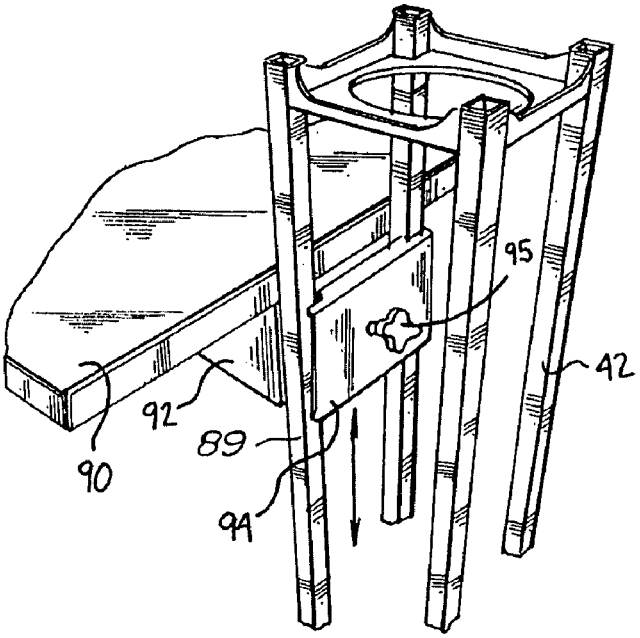
FIG. 8 is a perspective view of a table adjustably mounted on an elongate box frame.
Figure 7:
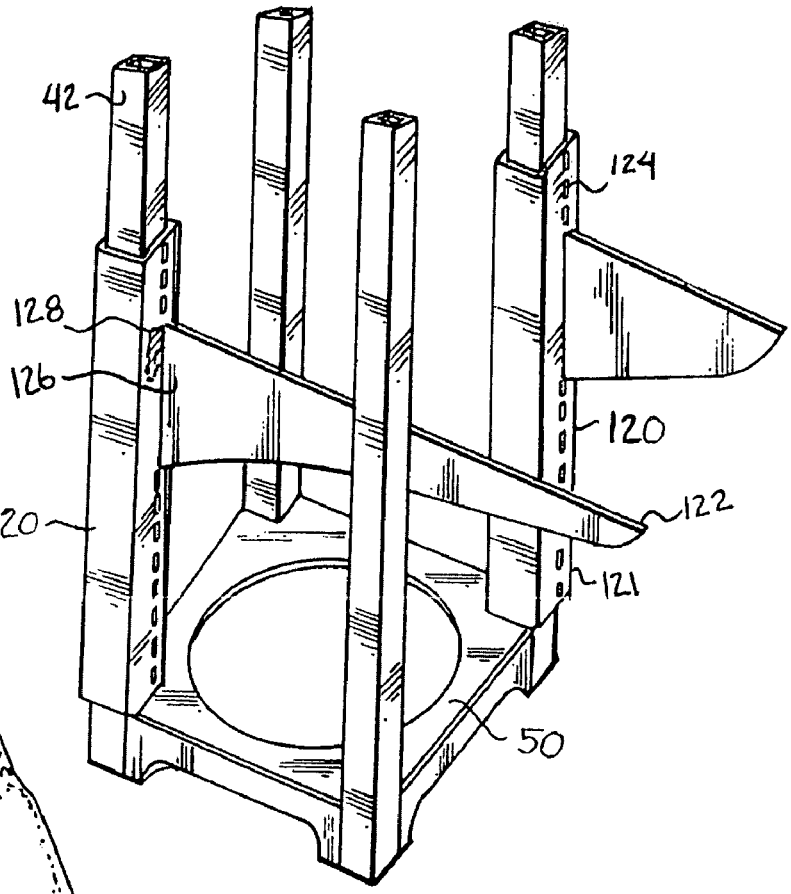
FIG. 7 is a perspective view of an elongate box frame and appurtenance attachment means.

Significantly, the elongated box frames 40 have an intermediate portion 89 positioned intermediate the end webbing 50; said intermediate portion 89 does not have any webbing or bracing. This facilitates four "clean" frame segments for variable positioning of appurtenances as illustrated in FIGS. 7 and 8, for providing an aesthetically pleasing and uncluttered look. In an ideal embodiment the clean intermediate portion 89 without webbing will constitute 70 percent or more of the length of the box frame 40.

As depicted in FIGS. 7 and 8, various appurtenances may be positioned along intermediate portion 89 of box frame 40. In FIG. 7, for example, a shelving support apparatus 120 is depicted. The apparatus generally includes a frame attachment portion 121 and a shelf support member 122. Shelf support member 122 may be a typical shelf support commonly used with adjustable shelving systems. As depicted in FIG. 7, the member 122 typically has a proximal end 126 with a plurality of downwardly directed hooks 128. Frame attachment portion 121 is u-shaped so as to fit over and secure to frame segments 42. A plurality of vertically aligned slots 124, each sized to receive a hook 128, are provided in frame attachment portion 121. Each shelf support member 122 may be attached to a frame attachment portion 121 by inserting hooks 128 into corresponding slots 124, and moving the shelf support downwardly, thereby hooking the hooks 128 into the slots 124. Another exemplary embodiment of a shelf support is depicted in FIG. 8. In this embodiment, shelf 90 has projecting portion 92 confronting frame segments 42. Threaded knob 95 extends through clamping portion 94, and threads into projecting portion 92. If threaded knob 95 is tightened, frame segments 42 are trapped and frictionally secured between projecting portion 92 and clamping portion 94, thereby providing a support for shelf 90. Shelf 90 may be positioned in any desired position along frame segments 42 by loosening threaded knob 95, sliding the shelf 90 along the frame segments 42 as depicted by the arrow until the desired position is reached, and retightening threaded knob 95.

Figure 6:
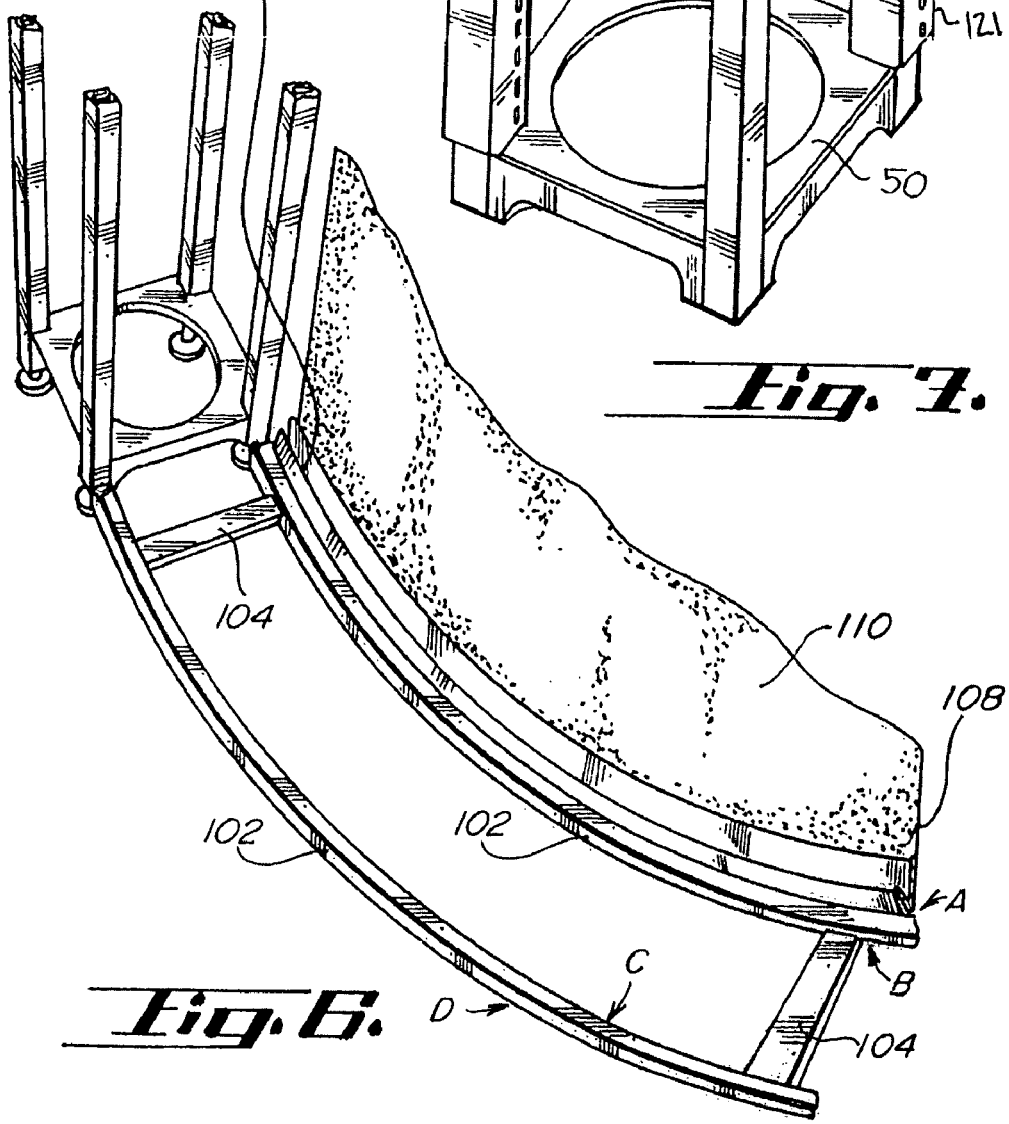
FIG. 6 is a perspective view of an elongate box frame, a truss and a graphic screen.

Referring to FIGS. 2, 4 and 6, details of the horizontal trusses 26 are illustrated. These trusses 26 may be linear in configuration as illustrated in FIGS. 4 and 1 or may be arcuate as illustrated in FIGS. 6 and 1. In either case, the trusses have parallel frame segments 102, which may be joined by webbing members 104 proximate the ends, or alternatively by conventional webbing 106 as depicted in FIG. 4.

As illustrated in FIG. 6, the horizontal trusses 26 are utilized for connection of the graphic screen panels 108 which due to the positioning of the u-shaped webbing 104 on the bottom of the bottom truss and the top of the top truss, allows positioning of the screens 108 in four positions as identified by the arrows labeled as A, B, C and D in FIG. 6. This provides an extraordinary amount of flexibility in mounting the graphical screen. The horizontal trusses, in an alternate embodiment of the display may utilize conventional webbing 106 as illustrated by the dashed lines of FIG. 4.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

The invention claimed is:

1. A display comprising:

a plurality of box frames forming an interconnectable rectangular framed section, each box frame having four proximately positioned elongate frame tubing segments and a plurality of discrete webbing connected to and spanning between each of the four tubing segments at spaced apart locations along the tubing, the frame tubing segments arranged to form a column substantially without angled cross-bracing intermediate vertically adjacent pairs of the discrete webbing, each of the discrete webbing extending between the four tubing segments for securing the four tubing segments together, the tubing segments having end portions with sockets for receiving a connector therein;

at least one generally horizontal truss member operably connectable to the sockets of the tubing segments such that the at least one generally horizontal truss member extends out generally transverse from the tubing segments; and at least one display screen operably connectable to the at least one generally horizontal truss member and the plurality of box frames to substantially span across the at least one generally horizontal truss member and along the plurality of box frames.

2. The display of claim 1, wherein the at least one generally horizontal truss is generally arcuate.

3. The display of claim 1, wherein the at least one generally horizontal truss is generally linear.

4. The display of claim 1, wherein each of the frame tubing segments are formed from generally rectangular tubing.

5. The display of claim 1, wherein the webbing includes a top plate portion and a plurality of side plate portions, each of the plurality of side plate portions extending generally transverse from said top plate portion, and each of the plurality of side plate portions being operably connected to adjacent frame tubing segments in a plane generally parallel to the adjacent frame tubing segments for bridging support.

6. The display of claim 1, wherein the at least one generally horizontal truss member includes a plurality of truss tubing segments, and a plurality of spaced apart support webbing extending between the plurality of truss tubing segments for bridging support.

7. The display of claim 6, wherein the plurality of truss tubing segments are formed from generally rectangular tubing.

8. A display wall comprising:

at least two spaced columns, each spaced column comprising at least one box frame, the at least one box frame including:

four proximately positioned frame tubing segments having first and second end portions, the four frame tubing segments generally defining the column;

a first support webbing operably transversely connected to and spanning between the tubing segments;

a second support webbing operably transversely connected to and spanning between the tubing segments at a location spaced apart from the first support webbing such that a portion of each frame tubing segment between the first and second support webbings is substantially free from angled bracing;

at least one generally horizontal truss connected to one of the first and second end portions of the frame tubing segments to define an open display region between the at least two spaced columns; and a display screen operably connected to the at least one generally horizontal truss and the at least two spaced columns to substantially fill the open display region.

9. The display wall of claim 8, wherein the at least one generally horizontal truss is generally arcuate.

10. The display wall of claim 8, wherein the at least one generally horizontal truss is generally linear.

11. The display wall of claim 8, wherein each of the frame tubing segments is of generally rectangular cross-section.

12. The display wall of claim 8, wherein the first and second support webbing include a top plate portion and a plurality of side plate portions, each of the plurality of side plate portions extending generally transverse from said top plate portion and being operably connected to adjacent frame tubing segments for bridging support.

13. The display wall of claim 8, wherein the at least one generally horizontal truss member includes a plurality of truss tubing segments, and a plurality of spaced apart support webbing extending between the plurality of truss tubing segments for bridging support.

14. The display wall of claim 13, wherein the plurality of truss tubing segments are of generally rectangular cross-section.

15. A display comprising:

a plurality of box frames forming an interconnectable rectangular framed section, each box frame having four proximate frame tubing segments and discrete webbing connected to the tubing segments at spaced apart locations, the frame tubing segments arranged in a columnar configuration, the webbing having side portions extending along a plane generally parallel to the frame tubing segments, the side portions further extending between adjacent tubing segments for bridging support;

at least one generally horizontal truss member operably connectable to the tubing segments such that the at least one generally horizontal truss member extends out generally transverse from the tubing segments; and at least one display screen operably connectable to the at least one generally horizontal truss member and the plurality of box frames to substantially span across the at least one generally horizontal truss member and along the plurality of box frames.

16. A display having a plurality of rectangular window frames, each window frame defining a window opening, at least one graphical screen positioned in at least one of said window openings, each graphical window frame comprising:

a pair of vertical columns, connected with a pair of horizontal trusses thereby defining the window opening, each of the two columns having a length greater than the length of each of the two trusses; and each column comprising four proximately positioned tubing segments arranged in a parallel configuration, a plurality of structures securing the segments together and spanning between the segments, a plurality of clean intermediate sections, each clean intermediate section positioned intermediate the structures securing the segments together, the clean intermediate sections not having any structure extending between the segments.

17. The combination display and graphical screen of claim 16 wherein the plurality of clean intermediate sections on each column is at least 70% of the length of said column.

18. A serpentine backwall display comprising discrete sections suitable for assembly and dissassembly at tradeshows, the backwall comprised of a sequential series of a plurality of rectangular window frames, each window frame positioned adjacent at least one other window frame, each window frame defined by two spaced apart columns and a lower truss and an upper truss spanning between said two spaced apart columns, each column having a top and a bottom and comprising four generally parallel pieces of generally straight tubing, each column having a horizontally extending webbing vertically positioned between the top and the bottom of said column, each webbing extending horizontally to span between each of the four pieces of generally straight tubing, and said webbing having a greater overall dimension horizontally than vertically, each column not having diagonal bracing, and wherein each window frame shares a vertical column with an adjacent window frame.

19. A dissassembleable backwall display for use at tradeshows comprised of:

a sequential series of rectangular window frames adjacent one another;

each window frame having two spaced apart columns, a lower truss, and an upper truss, the columns having four generally parallel pieces of generally straight tubing;

each column having a horizontally extending webbing vertically positioned between a top and a bottom of said column;

each webbing extending horizontally between each of the four pieces of generally straight tubing; and said webbing having a greater dimension horizontally than vertically.

* * * * *